US007761021B2

(12) United States Patent
Takeuchi

(10) Patent No.: US 7,761,021 B2
(45) Date of Patent: Jul. 20, 2010

(54) USER INTERFACE FOR SELECTING FEED PORT AND PRINTING MEDIUM SIZE

(75) Inventor: Chiemi Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 171 days.

(21) Appl. No.: 11/901,929

(22) Filed: Sep. 19, 2007

(65) Prior Publication Data

US 2008/0069583 A1 Mar. 20, 2008

(30) Foreign Application Priority Data

Sep. 20, 2006 (JP) ..... 2006-254016
Aug. 6, 2007 (JP) ..... 2007-204108

(51) Int. Cl.
*G03G 15/00* (2006.01)

(52) U.S. Cl. ..... 399/81; 399/45; 399/389

(58) Field of Classification Search ..... 399/45, 399/81, 389; 358/1.1, 1.12, 1.18
See application file for complete search history.

(56) References Cited

U.S. PATENT DOCUMENTS

| | | | | |
|---|---|---|---|---|
| 6,516,178 | B2 * | 2/2003 | Fukushima | 399/376 |
| 2005/0179914 | A1 * | 8/2005 | Fuse | 358/1.2 |
| 2006/0239731 | A1 * | 10/2006 | Suzuki et al. | 399/389 |
| 2006/0268328 | A1 * | 11/2006 | Park et al. | 358/1.15 |
| 2007/0165248 | A1 * | 7/2007 | Utsunomiya et al. | 358/1.1 |

FOREIGN PATENT DOCUMENTS

| | | |
|---|---|---|
| JP | 2004-268364 | 9/2004 |
| JP | 2004-334285 | 11/2004 |
| JP | 2005-215972 | 8/2005 |
| JP | 2005-301888 | 10/2005 |
| JP | 2005-342953 | 12/2005 |
| JP | 2006-244035 | 9/2006 |

* cited by examiner

*Primary Examiner*—David M Gray
*Assistant Examiner*—G. M. Hyder
(74) *Attorney, Agent, or Firm*—Nutter McClennan & Fish LLP; John J. Penny, Jr.; Michael P. Visconti, III

(57) ABSTRACT

A printer control method for controlling, by means of a computer equipped with a display screen, a printer having a plurality of feed ports for feeding a printing medium. The printer control method comprises the steps of (a) through (d). The step (a) is a step of displaying on the display screen: a feed port specifying portion for specifying at least one of the feed ports from the plurality of feed ports; a first size display portion for displaying information relating to printing medium size; and a first size specifying portion for the user to specify a printing medium size to be printed, on the basis of the information relating to printing medium size displayed on the first size display portion. The step (b) is a step of, from pre-registered user-defined printing medium sizes, identifying the user-defined printing medium size included within a printing medium size permissible range dependent upon the feed port specified through the feed port specifying portion. The step (c) is a step of controlling the printer so as to carry out printing of the printing medium size specified through the first size specifying portion. Wherein in step (a), information relating to the user-defined printing medium size identified in step (b) is displayed on the first size display portion.

8 Claims, 14 Drawing Sheets

USER INTERFACE FOR SELECTING FEED PORT AND PRINTING MEDIUM SIZE

CROSS REFERENCE TO RELATED APPLICATIONS

This application relates to and claims priority from Japanese Patent Applications No. 2006-254016 filed on Sep. 20, 2006 and No. 2007-204108 filed on Aug. 6, 2007, the entire disclosures of which are incorporated herein by reference.

BACKGROUND

1. Technical Field

The present invention relates to a printer control method for computer control of a printer having multiple feed ports.

2. Description of the Related Art

In a printer equipped with multiple feed ports, loadable paper size may differ depending on the paper feed port. For example, in a case where a printer has two paper feed ports identical in planar shape but with one being of cassette design and the other of tray design, where the paper sizes that can be loaded in the respective paper feed ports are compared, the maximum size of the paper that can be loaded will be smaller with the cassette design than with the tray design, owing to the paper size limitation imposed by the dimensions of the cassette. As another example, where a printer is equipped with one feed port each on the front and back faces of the printer, and the paper discharge port is disposed on the front face of the printer, paper fed in through the paper feed port provided on the front face (hereinafter termed the front paper feed port) will travel on a double-back paper path inside the printer to be discharged through the paper discharge port, whereas paper fed in through the paper feed port provided on the back face (hereinafter termed the back paper feed port) travel along a direct paper path without double-back to be discharged through the paper discharge port. Since paper fed in through the front paper feed port must be of sufficient size for double-back to be possible, the minimum loadable paper size will be larger than for the back paper feed port.

Some printers of this kind, which allow printing using paper of any size specified by the user (hereinafter termed user-defined paper size), in addition to the standard paper sizes of A4, B5 and so on, is described in JP2005-342953A, for example.

When the user attempts to print with paper of user-defined paper size from a printer of the type discussed above, depending which the paper feed port is specified by the user, the user-defined paper size may lie outside the range of paper sizes that can be loaded in the specified paper feed port (such as being too small, for example), resulting in an experience of inconvenience.

SUMMARY

An object of the present invention is to provide enhanced convenience for the user when using a printer equipped with multiple paper feed ports having different loadable paper size ranges, to print paper of user-defined paper size.

In one aspect of the present invention, there is provided a printer control method for controlling, by means of a computer equipped with a display screen, a printer having a plurality of feed ports for feeding a printing medium. The printer control method comprises the steps of (a) through (d). The step (a) is a step of displaying on the display screen: a feed port specifying portion for specifying at least one of the feed ports from the plurality of feed ports; a first size display portion for displaying information relating to printing medium size; and a first size specifying portion for the user to specify a printing medium size to be printed, on the basis of the information relating to printing medium size displayed on the first size display portion. The step (b) is a step of, from pre-registered user-defined printing medium sizes, identifying the user-defined printing medium size included within a printing medium size permissible range dependent upon the feed port specified through the feed port specifying portion. The step (c) is a step of controlling the printer so as to carry out printing of the printing medium size specified through the first size specifying portion. Wherein in step (a), information relating to the user-defined printing medium size identified in step (b) is displayed on the first size display portion.

Herein, printing medium is a concept to include various media such as so-called plain paper, photo paper, label paper, OHP sheets, copier paper, and the like. User-defined paper size is refers to the size of a printing medium specified arbitrarily by the user. For example, this could be a size other than the standard sizes of A4, B5 and so on. The information relating to printing medium size could be any information by which it is possible to identify the printing medium size, for example, the printing medium size name (A4, postcard, etc.) or dimensions (OO mm×OO mm).

For example, when loadable printing medium size ranges for feed ports have been predetermined by way of permissible printing medium size ranges, according to this printer control method, information relating to user-defined paper size will not be displayed on the first size display portion for a size that is not loadable in the specified feed port. Thus, even where loadable printing medium size ranges differ among individual feed ports, when the user specifies a desired printing medium size for printing he or she will able to specify a proper printing medium size and be prevented from mistakenly specifying a printing medium size that cannot be loaded in the specified paper feed port.

The present invention can be realized in various aspects. For example, the present invention can be realized in aspects such as a printer control method and associated apparatus, a computer program that executes the functions of the method and the apparatus, a printing medium on which such computer program is recorded, or a data signal encoded in a carrier wave that incorporates this computer program.

These and other objects, features, aspects, and advantages of the present invention will become more apparent from the following detailed description of the preferred embodiments with the accompanying drawings.

DESCRIPTION OF THE PREFERRED EMBODIMENT

Next, aspects of the present invention will be described in the following order on the basis of embodiment:

A. Embodiment 1

A1. Configuration of Embodiment 1

A2. Operation of Embodiment 1

B. Embodiment 2

A. Embodiment 1

A1. Configuration of Embodiment 1

Figure 1:
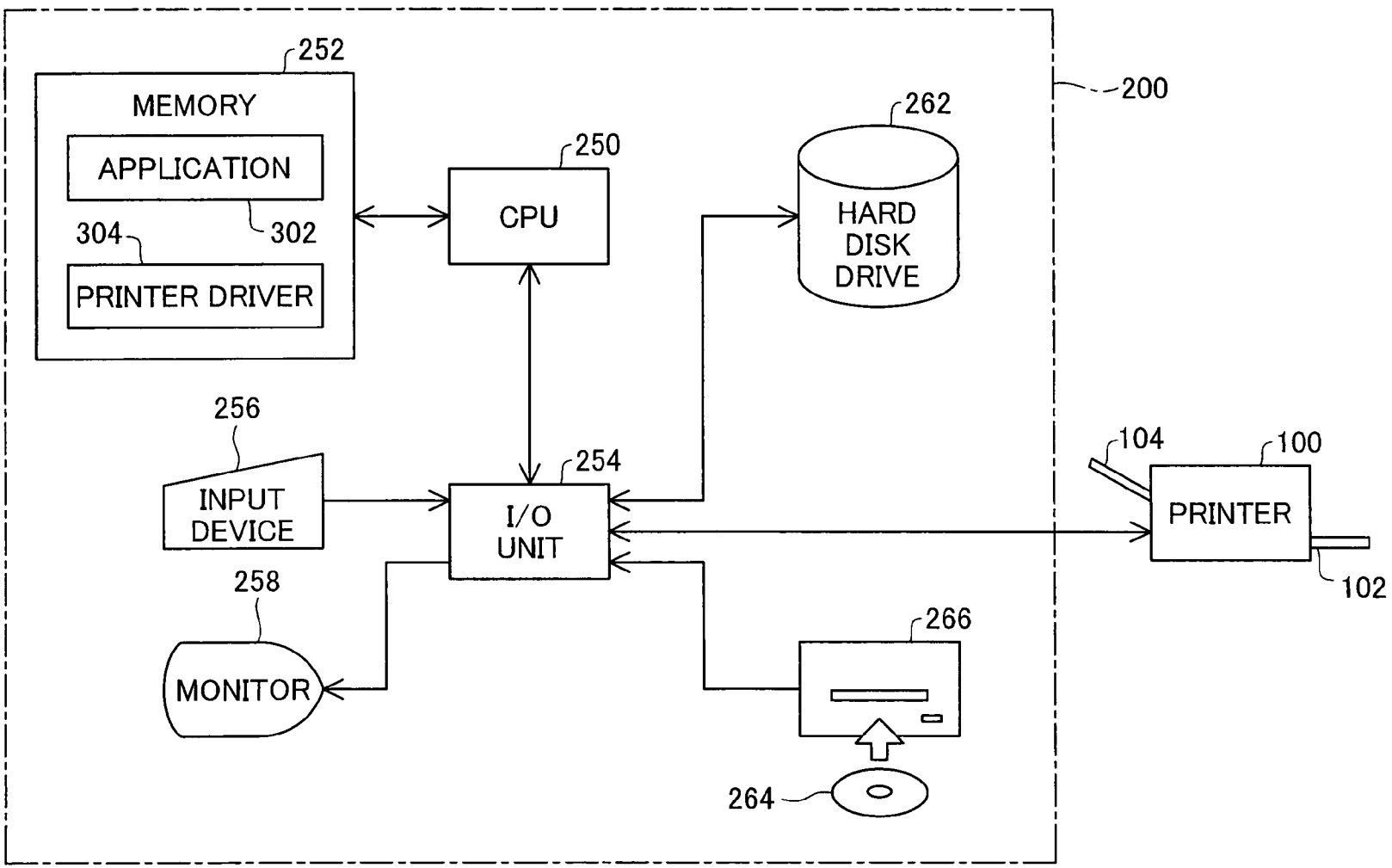
FIG. 1 is a block diagram showing the construction of a printing system composed of a printer and a computer that stores a printer driver program as a first embodiment of the present invention and functions as a printing control device.

FIG. 1 is a block diagram showing the construction of a printing system composed of a printer and a computer that stores a printer driver program as a first embodiment of the present invention and functions as a printing control device.

The printing system shown in FIG. 1 is composed of a printer 100 and a computer 200; of these, the computer 200 includes a CPU 250 for carrying out various processes and control in accordance with a computer program; a memory 252 for storing the computer program and for saving data obtained during processing; an I/O unit 254 for data exchange with various peripheral devices; an input device 256 composed of a keyboard, pointing device or the like, for the user to input instructions and so on; a monitor 258 composed of a CRT, LCD or the like, for displaying images and so on; a hard disk drive 262 for storing image data and the like; and a CD-ROM drive 266 for reading a CD-ROM 264 having the aforementioned the computer program or the like written thereon. The printer driver program pertaining to an first embodiment of the present invention is saved in the memory 252, together with information relating to print settings, such as paper information, specific paper information, and user-defined paper size; and application programs, et cetera.

By reading and executing an application program saved in the memory 252 the CPU 250 functions as an application 302; and by reading and executing the printer driver program it functions as printer driver 304.

In the present embodiment, as shown in FIG. 1, the computer program saved in the memory 252 has been provided in a form recorded on the CD-ROM 264 as the printing medium, and is loaded into the computer by means of being read by the CD-ROM drive 266. The read out computer program is transferred to the hard disk drive 262, and is subsequently transferred to the memory 252 when started up, for example. Alternatively, the read computer program could be transferred directly to the memory 252, rather than through the agency of the hard disk drive 262.

As shown in FIG. 1, the printer 100 is provided on its front face (situated to the right on the page) with a front end paper cassette 102 as the front paper feed port, and on the back face (situated to the left on the page) with a back end auto sheet feeder 104 as the back paper feed port. The paper size loadable in the front end paper cassette 102 has a paper width dimension of between 89.0 and 215.9 mm, and a paper length dimension of between 127.0 and 297.0 mm. On the other hand, the paper size loadable in the back end auto sheet feeder 104 has a paper width dimension of between 89.0 and 215.9 mm, and a paper length dimension of between 89.0 and 1117.6 mm.

The printer 100 has three preset paper feed methods: a first paper feed method whereby paper is fed from the front end paper cassette 102, a second paper feed method whereby paper is fed from back end auto sheet feeder 104, and a third paper feed method whereby paper is fed while switching between the front end paper cassette 102 and the back end auto sheet feeder 104.

A2. Operation of Embodiment 1

Figure 2:
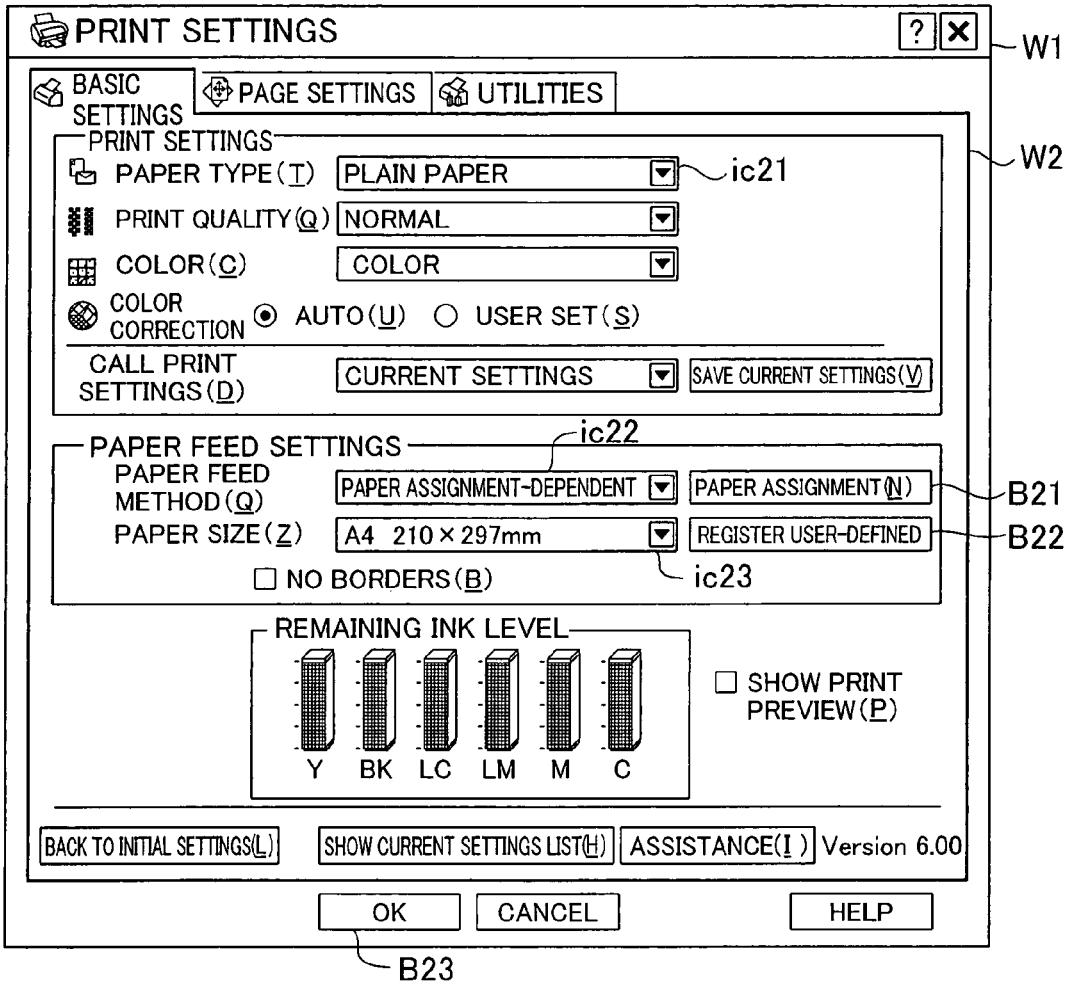
FIG. 2 is a diagram showing a print settings window W1.

When the application 302 is started up, once the user operates the input device 256 and selects "Print" from the application 302, the printer driver 304 will run; if the user now selects the Properties button (not shown) in order to make print settings, the printer driver 304 will display a print settings window W1 like that shown in FIG. 2 on the display screen of the monitor 258.

FIG. 2 is a diagram showing a print settings window W1 allowing the user to set paper type, paper size, paper feed method, and other properties during printing. As shown, the print settings window W1 includes three tabs: "Basic Settings," "Page Settings," and "Utilities"; selecting each of the tabs in turn brings up display of the corresponding Settings windows. The print settings window W1 also includes various buttons, such as an OK button B23 allowing the user to confirm various settings made from the Settings windows mentioned above.

In FIG. 2, the "Basic Settings" is shown selected from the print Settings window W1. The basic settings window W2 includes inter alia a paper type input field ic21 for inputting paper type; a paper feed method input field ic22 for inputting paper feed method; and a paper size input field ic23 for inputting paper size. These input fields are designed so that the user can select and enter the desired item from a pull down menu. In the pull down menu of the paper feed method input field ic22, the aforementioned first paper feed method is shown as "Front end paper cassette," the second paper feed method as "Back end auto sheet feeder," and the third paper feed method as "Paper assignment-dependent." There is also provided a Paper assignment button B21 for displaying a paper assignment window W4 like that shown in FIG. 6 (discussed later), when the user has selected "Paper assignment-dependent" in the paper feed method input field ic22. The Paper assignment button B21 is selectable only when the user has entered "Paper assignment-dependent" in the paper feed method input field ic22; where "Front end paper cassette" or Back end auto sheet feeder" has been selected, the button will not be selectable and will be displayed grayed-out.

The paper feed method input field ic22 in the present embodiment corresponds to the element of the feed port specifying portion recited in the claims, and the paper size input field ic23 corresponds to the element of the size specifying portion recited in the claims, respectively. Specifically, where "Front end paper cassette" or "Back end auto sheet feeder" has been entered in the paper feed method input field ic22, the respective paper feed ports will be specified, whereas if "Paper assignment-dependent" has been entered, the two paper feed ports "Front end paper cassette" and "Back end auto sheet feeder" will be specified.

Figure 3:
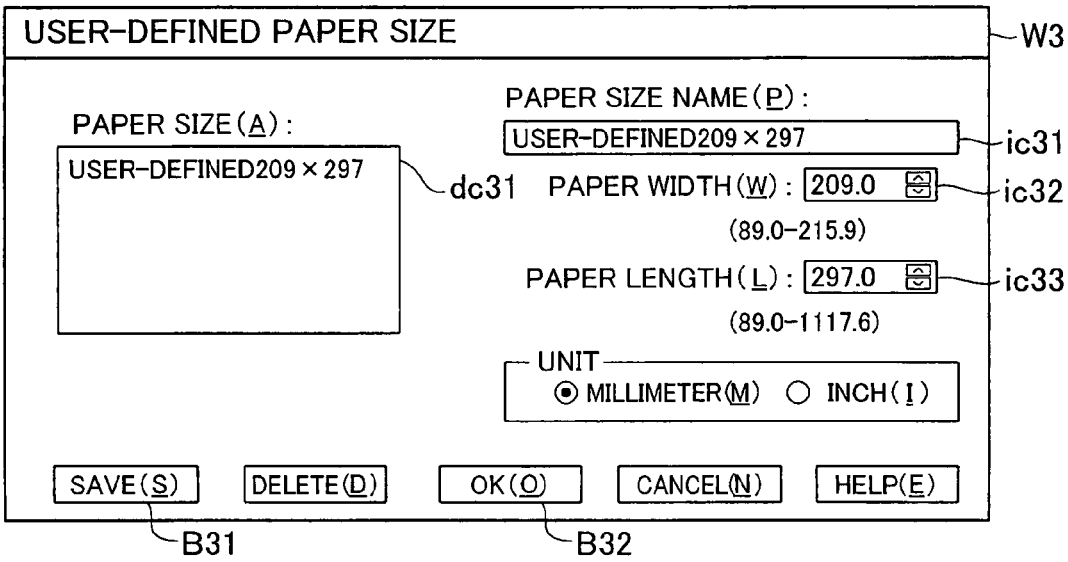
FIG. 3 is a diagram showing a user-defined paper size window W3.

There is also provided a Register user-defined paper size button B22 for bringing up display of a user-defined paper size window W3 (FIG. 3). The user-defined paper size window W3 is a dialog box allowing the user to define a non-standard paper size, when it is desired to load paper of non-standard size in the front end paper cassette 102 or the back end auto sheet feeder 104.

FIG. 3 is a diagram showing a user-defined paper size window W3. As shown, the user-defined paper size window W3 includes a user-defined paper name display portion dc31, a user-defined paper name input field ic31, a user-defined paper width input field ic32, and a user-defined paper length input field ic33. Also provided are various buttons such as a Save button B31 and an OK button B32.

The user-defined paper name display portion dc31 in the present embodiment corresponds to the element of the size display portion recited in the claims, and the Save button B31 corresponds to the element of the registration instruction portion recited in the claims.

For example, when in "Paper assignment-dependent" mode, the user desires to print using non-standard paper, first, the user will select "Paper assignment-dependent" from the paper feed method pull down menu (not shown) of the basic settings window W2 shown in FIG. 2, and enter the selection in the paper feed method input field ic22. Next, as will be discussed later, the user will define and register a non-standard paper size.

When the user then selects the Register user-defined paper size button B22 (FIG. 2), the printer driver 304 will display the user-defined paper size window W3 (FIG. 3), shown superimposed over the print settings window W1 on the display screen of the monitor 258. At this time, the printer driver 304 will verify that "Paper assignment-dependent" has been entered as the paper feed method in the paper feed method input field ic22, and will determine a definable paper size range having width of between 89.0 and 215.9 mm (hereinafter termed the permissible back end paper width range) and length of between 89.0 and 1117.6 mm (hereinafter termed the permissible back end paper length range). This range represents the range of paper sizes loadable in the back end auto sheet feeder 104 described in A1. Configuration of Embodiment 1. The printer driver 304 will then display in brackets the back end paper width and the back end paper length, shown below the user-defined paper width input field ic32 and the user-defined paper length input field ic33, respectively.

In similar manner, where the paper feed method is "Back end auto sheet feeder," the printer driver 304 will determine a definable paper size range of prescribed back end paper width and back end paper length. On the other hand, where the paper feed method is "Front end paper cassette," there will be determined a definable paper size range having width of between 89.0 and 215.9 mm (hereinafter termed the permissible front end paper width range) and length of between 127.0 and 297.0 mm (hereinafter termed the permissible front end paper length range). This range represents the range of paper sizes loadable in the front end paper cassette 102.

The permissible back end paper width range, permissible back end paper length range, permissible front end paper width range, and permissible front end paper length range in the present embodiment correspond to the element of the permissible printing medium size ranges recited in the claims.

As shown in FIG. 3, if the user enters "User-defined 209×297" in the user-defined paper name input field ic31, "209.0" in the user-defined paper width input field ic32, and "297.0" in the user-defined paper length input field ic33, and then selects the Save button B31, the printer driver 304 will acquire the values entered in the respective input fields and will decide that the values respectively lie within the permissible back end paper width range (89.0-215.9 mm) and the permissible back end paper length range (89.0-1117.6 mm) constituting the definable paper size range, whereupon the parameters of user-defined paper name=user-defined 209×297, user-defined paper width=209.0, and user-defined paper length=297.0 will be saved in associated form in the memory 252, and "User-defined 209×297" will be displayed in the user-defined paper name display portion dc31. If the values entered in the respective input fields do not lie within the permissible back end paper width range or the permissible back end paper length range, the printer driver 304 will modify these to in-range values and display them in the input fields. For example, if the user has entered 88.0 in the user-defined paper width input field ic32, the printer driver 304 will change the entered value to the closest value of 89.0 lying within the permissible back end paper width range (89.0-215.9 mm) and display it in the user-defined paper width input field ic32. Similarly, if the user has entered 217.0, the printer driver 304 will change the entered value to the closest value of 215.9 lying within the permissible back end paper width range, and display it.

Next, if the user enters "user-defined 209×1000" in the user-defined paper name input field ic31, "209.0" in the user-defined paper width input field ic32, and "1000.0" in the input field ic33 and selects the Save button B31, the printer driver 304 will similarly save the associated parameters of user-defined paper name=user-defined 209×1000, user-defined paper width=209.0, and user-defined paper length=1000.0 as user-defined paper information 2 in the memory 252, and in addition to "User-defined 209×297" will display "User-defined 209×1000" in the user-defined paper name display portion dc31. The OK button B32 will then be selectably displayed on the user-defined paper size window W3.

When the user then selects the OK button B32, the printer driver 304 closes the user-defined paper size window W3. At this time, the print settings window W1 will be displayed on the display screen of the monitor 258.

By means of this procedure, the user can define and register non-standard paper sizes. As will be discussed later, the user can specify the defined paper size (hereinafter termed the user-defined paper size) as the paper size for loading and printing from the front end paper cassette 102 or the back end auto sheet feeder 104.

Figure 4:
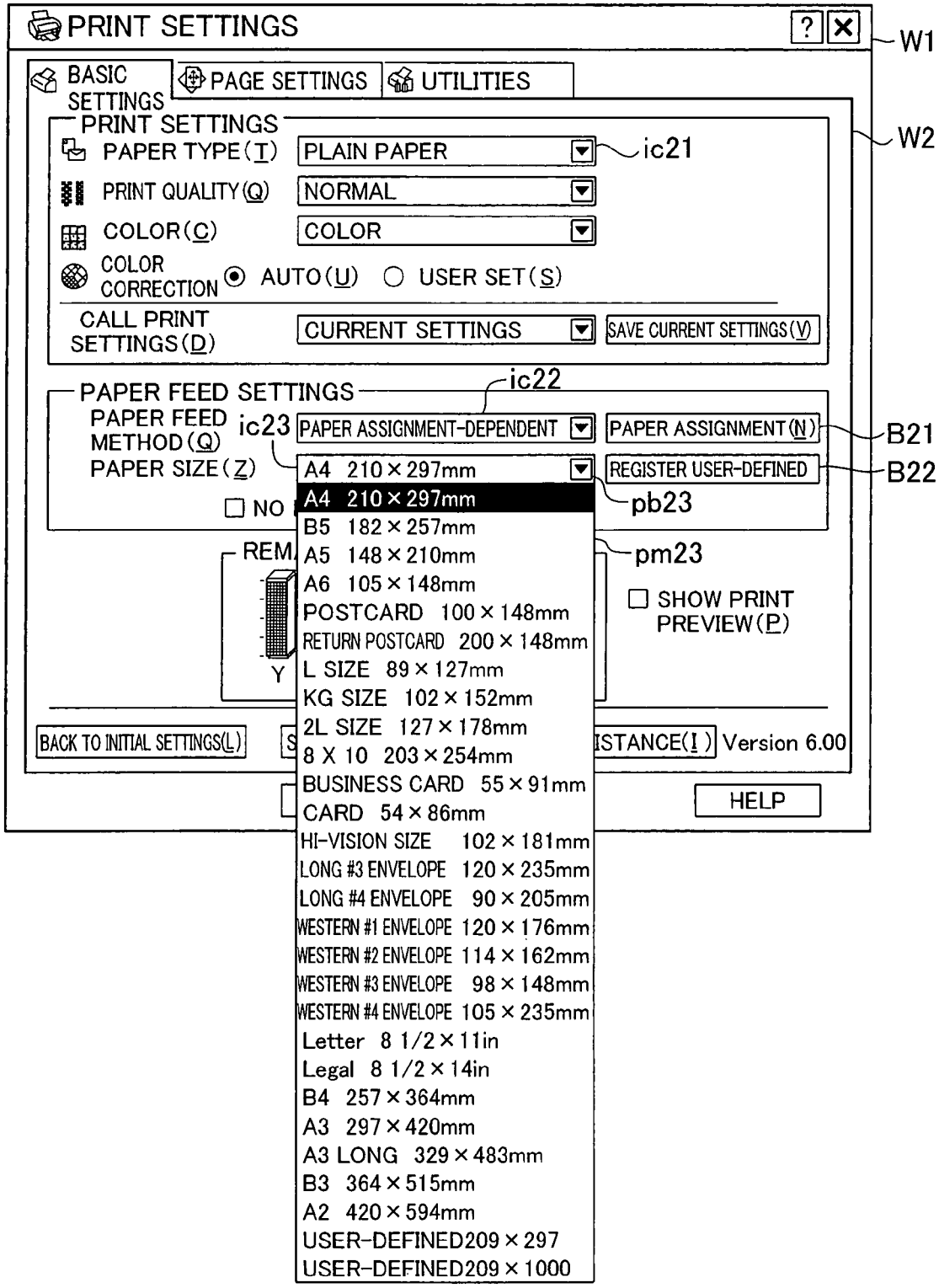
FIG. 4 is a diagram showing a paper size pull down menu pm23.
Figure 5:
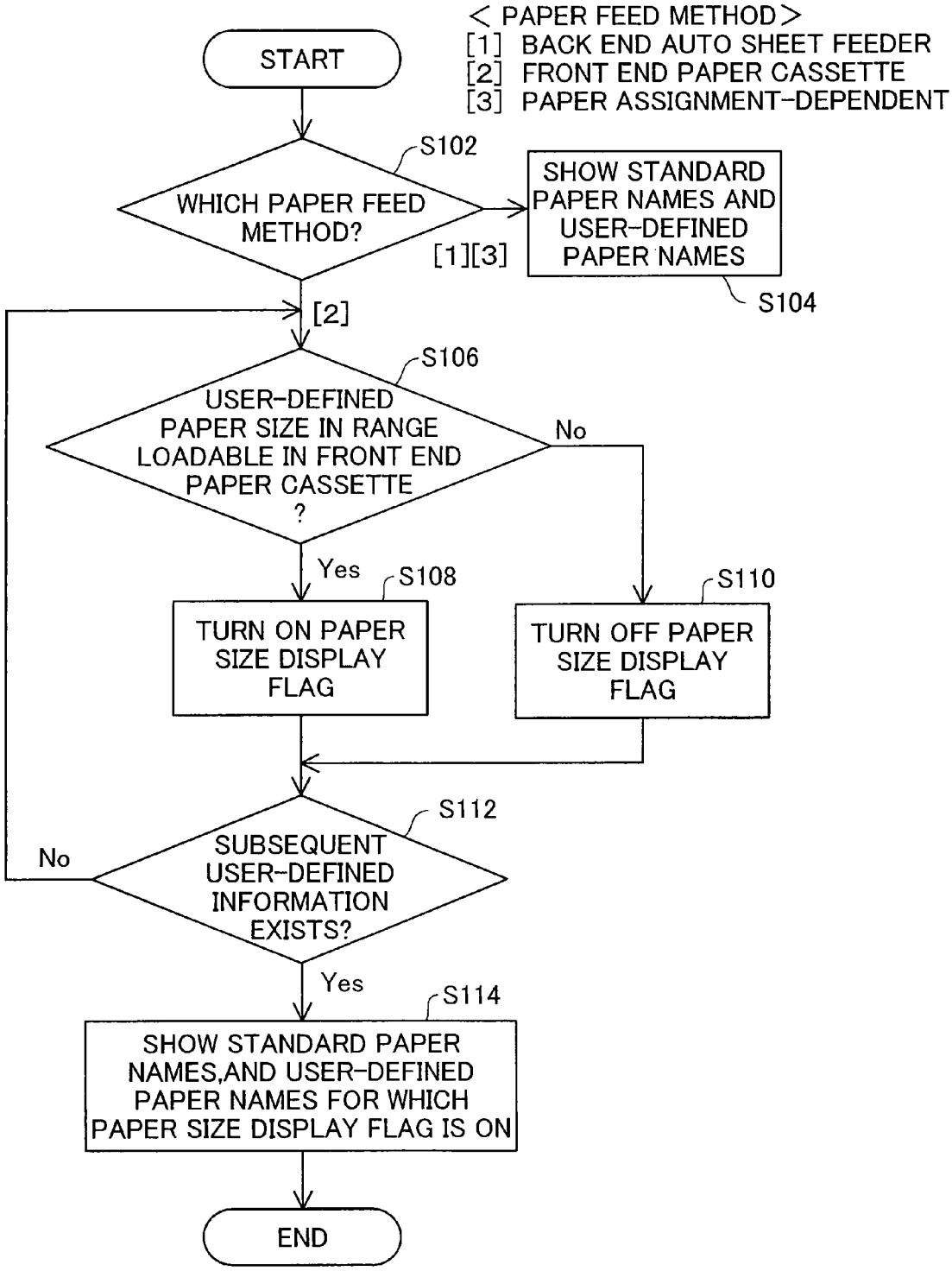
FIG. 5 is a flowchart showing a process for displaying paper names on the paper size pull down menu pm23.

Next, when the user selects a pull down button pb23 in the paper size input field ic23 from the basic settings window W2 shown in FIG. 2, the printer driver 304 will display a paper size pull down menu pm23 as shown in FIG. 4. FIG. 4 is a diagram showing a paper size pull down menu pm23. FIG. 5 is a flowchart showing a process for displaying paper names on the paper size pull down menu pm23. The paper size pull down menu pm23 in the present embodiment corresponds to the element of the first size display portion recited in the claims.

As shown in FIG. 5, as the paper size pull down menu pm23 is being displayed, the printer driver 304 will determine the paper feed method that has been entered in the paper feed method input field ic22 (Step S102), and if this is verified to be "Paper assignment-dependent" (Step S102: [3]), will display in the paper size pull down menu pm23 the user-defined paper names "User-defined 209×297" and "User-defined 209×1000," together with the paper names of standard papers (predetermined) loadable in the back end auto sheet feeder 104 (Step S104), as shown in FIG. 4.

Similarly, when "Back end auto sheet feeder" has been entered in the paper feed method input field ic22, the user-defined paper name saved in the memory 252 will be displayed together with the paper names of standard papers loadable in the back end auto sheet feeder 104, on the paper size pull down menu pm23 (Step S102: [1]; Step S104).

If on the other hand, "Front end paper cassette" has been entered in the paper feed method input field ic22 (Step S102: [2]), the printer driver 304 will decide whether the user-defined paper size (user-defined paper width and user-defined paper length) saved in the memory 252 lies within the respective ranges for paper loadable in the front end paper cassette 102 (i.e. permissible front end paper width range: 89.0-215.9 mm and permissible front end paper length range: 127.0-297.0) (Step S106). Specifically, the printer driver 304 will make the decision by first acquiring the user-defined paper information 1 (user-defined paper name=user-defined 209×297) constituting the initial user-defined paper information included in the user-defined paper information saved in the memory 252; then comparing the width and length indicated by this information with the permissible front end paper width range and permissible front end paper length range. The printer driver 304 will decide that, since the user-defined paper width of the user-defined paper information 1 is 209.0, the value lies within the permissible front end paper width range; and that since the user-defined paper length is 297.0, the value lies within the permissible front end paper length range (Step S106: Yes). Then, since the user-defined paper width and user-defined paper length are both in-range, the printer driver 304 will set to ON a paper size display flag of the user-defined paper information 1 saved in the memory 252 (Step S108).

Next, the printer driver 304 will check the user-defined paper information 2 (Step S112: No) and make a decision in the same manner as above with regard to the user-defined paper information 2 (user-defined paper name=user-defined 209×1000), as a result of which it will be decided that the user-defined paper length exceeds the permissible front end paper length range and does not lie within the size range loadable in the front end paper cassette 102 (Step S106: No); and the paper size display flag of the user-defined paper information 2 saved in the memory 252 will be set to OFF (Step S110). The printer driver 304 will then check that no subsequent user-defined information is saved in the memory 252 (Step S112: Yes); extract from the user-defined paper information saved in the memory 252 that information for which the paper size display flag is ON, and display the user-defined paper name included in that user-defined paper information (Step S114).

Specifically, because the paper size display flag of the user-defined paper information 1 is ON, the printer driver 304 will display "user-defined 209×297" on the paper size pull down menu pm23; and because the paper size display flag of the user-defined paper information 2 is OFF, the printer driver 304 will not display "user-defined 209×1000" on the paper size pull down menu pm23. The printer driver 304 will also display on the paper size pull down menu pm23 the paper names of standard papers (predetermined) loadable in the front end paper cassette 102. The paper names of standard papers for display on the paper size pull down menu pm23 have been previously saved in the memory 252, on a separate basis for the case where "Back end auto sheet feeder" or "Paper assignment-dependent" has been selected as the paper feed method and the case where "Front end paper cassette" has been selected as the paper feed method; on the basis of the paper feed method that has been entered in the paper feed method input field ic22, the corresponding the paper names of standard papers will be read out and displayed.

In this way, when the user selects the desired paper size from the paper size pull down menu pm23 and enters this size in the paper size input field ic23, with regard to user-defined paper names, on the basis of the paper feed method that has been entered in the paper feed method input field ic22 the paper size pull down menu pm23 will show those user-defined paper names that lie within the paper size range loadable in the paper feed port to be used for paper feed, and will not show any out-of-range user-defined paper names. Accordingly, the user can select a user-defined paper name of paper size appropriate for the paper feed port to be used for paper feed.

When the user then selects "user-defined 209×1000" from the paper size pull down menu pm23 and enters this size in the paper size input field ic23, the printer driver 304 will save the paper size=user-defined 209×1000 as paper information in the memory 252. When the user selects "Plain Paper" from a paper type pull down menu (not shown) and enters this type in the paper type input field ic21, the printer driver 304 will save the paper type=plain paper as paper information in the memory 252.

Figure 6:
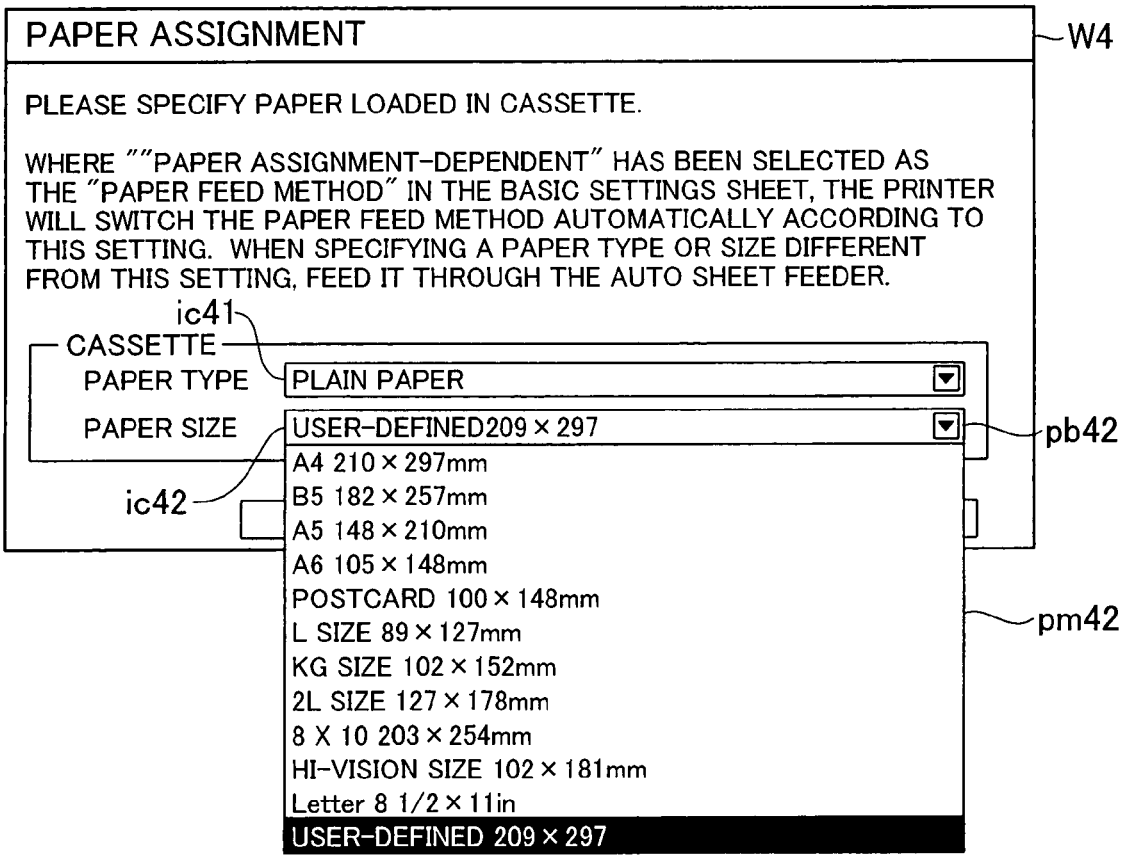
FIG. 6 is a diagram showing a paper assignment window W4.

Next, when the user selects the Paper assignment button B21 (FIG. 4), the printer driver 304 displays the paper assignment window W4 shown in FIG. 6, superimposed over the print settings window W1 on the display screen of the monitor 258. FIG. 6 is a diagram showing a paper assignment window W4. The paper assignment window W4 is a window for specifying paper to be loaded in the front end paper cassette 102, and includes a paper type input field ic41 for entering paper type (plain paper, photo paper, postcard, etc.) and a paper size input field ic42 for entering paper size (A4, B5, postcard, etc.). These input fields enable the user to select and enter a desired item from a pull down menu.

When the user selects the pull down button pb42 of the paper size input field ic42, the printer driver 304 will display the specific paper size pull down menu pm42 shown in FIG. 6. At this time, by a procedure similar to that described above, the printer driver 304 will decide whether the user-defined paper size (user-defined paper width and user-defined paper length) saved in the memory 252 lie within the permissible front end paper width range (89.0-215.9 mm) and permissible front end paper length range (127.0-297.0 mm). Since the user-defined paper size of the user-defined paper information 1 (user-defined paper name=user-defined 209×297) lies within the permissible front end paper width and permissible front end paper length range, the printer driver 304 will set to ON the specific paper display flag (discussed later) that is stored in the memory 252. On the other hand, since the user-defined paper size of the user-defined paper information 2 (user-defined paper name=user-defined 209×1000) is outside the user-defined paper width and user-defined paper length ranges, the printer driver 304 will set the specific paper display flag to OFF.

The printer driver 304 will then extract from the user-defined paper information saved in the memory 252 that information for which the specific paper display flag is ON, and selectably display the user-defined paper name on the specific paper size pull down menu pm42. Specifically, since the specific paper display flag of the user-defined paper information 1 is ON, only "user-defined 209×297" will be displayed selectably on the specific paper size pull down menu pm42. The printer driver 304 will also display on the paper size pull down menu pm23 the paper names of standard papers (predetermined) loadable in the front end paper cassette 102 (FIG. 6).

The paper size input field ic42 in the present embodiment corresponds to the element of the second size specifying portion recited in the claims, and the specific paper size pull down menu pm42 corresponds to the element of the second size display portion recited in the claims.

In this way, to specify from the paper assignment window W4 the paper to be loaded in the front end paper cassette 102, the user will select the paper size name corresponding to the desired paper size from the specific paper size pull down menu pm42 and enter it in the paper size input field ic42, at which time, with regard to user-defined paper sizes, user-defined paper sizes lying within the paper size range loadable in the front end paper cassette 102 will be displayed on the specific paper size pull down menu pm42, while out-of-range user-defined paper sizes will not be shown. Accordingly, the user will be able to select a user-defined paper size name of appropriate paper size.

The user will then select "user-defined 209×297" from the specific paper size pull down menu pm42 (FIG. 6), enter this value in the paper size input field ic42, select "Plain Paper" from an specific paper type pull down menu (not shown), enter this type in the paper type input field ic41, and select the OK button (not shown), whereupon the printer driver 304 will save the paper type=plain paper, paper size=user-defined 209×297 as specific paper information in the memory 252, and then close the paper assignment window W4. At this time, the print settings window W1 (FIG. 2) will be displayed on the display screen of the monitor 258.

Figure 7:
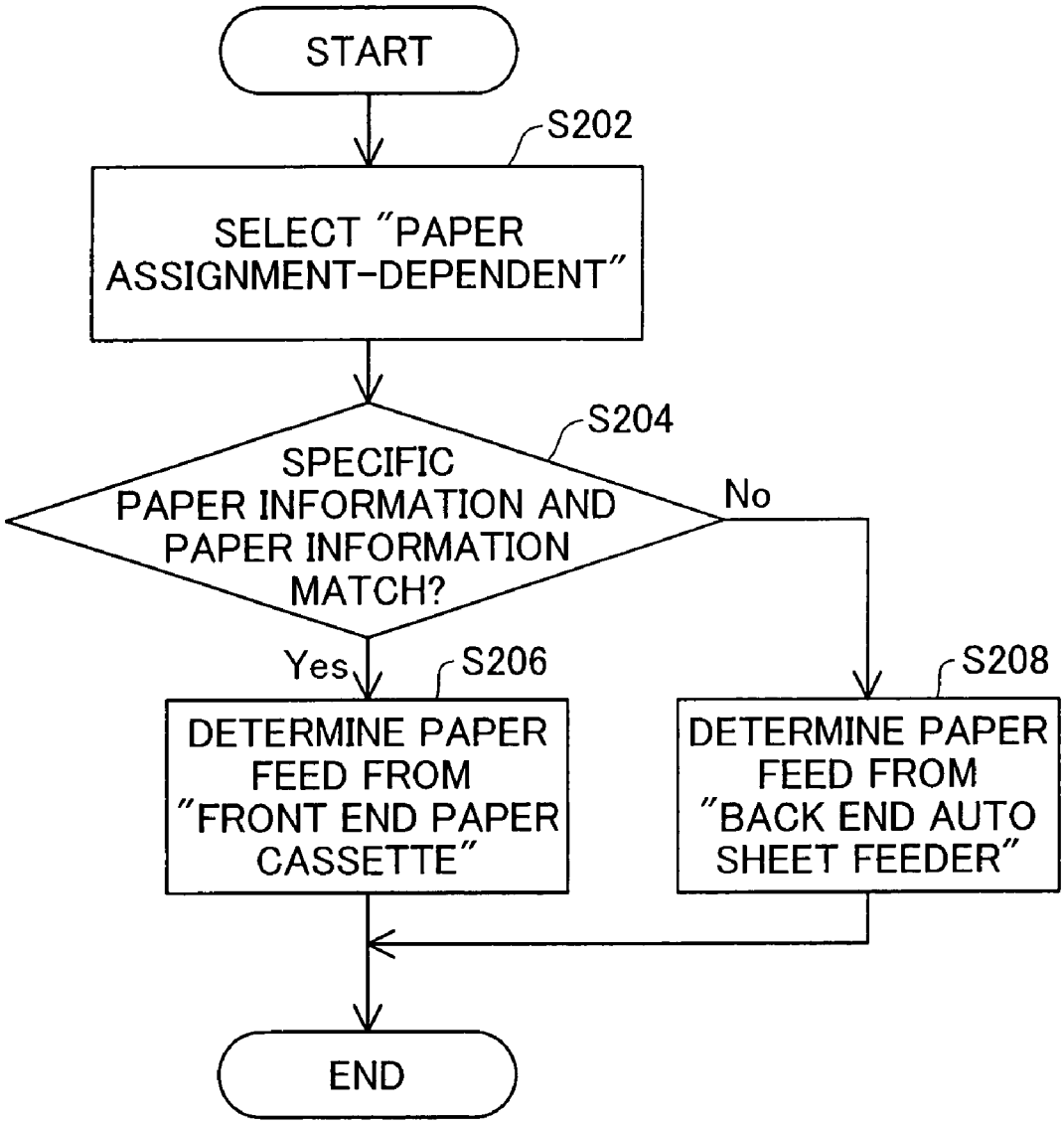
FIG. 7 is a flowchart showing a process for determining the paper feed port to be used.

In this way, when from the basic settings window W2, the user enters "Paper assignment-dependent" as the paper feed method, enters the paper type and paper size, and then from the paper assignment window W4 enters the paper type and paper size of paper for loading into the front end paper cassette 102, the printer driver 304 will determine the paper feed port to be used, by the procedure described below. FIG. 7 is a flowchart showing a process for determining the paper feed port to be used.

As shown in FIG. 7, the printer driver 304 checks whether "Paper assignment-dependent" has been entered in the paper feed method input field ic22 (Step S202), and decides whether the paper information saved in memory matches the specific paper information (Step S204). As mentioned previously, since paper type=plain paper, paper size=user-defined 209×297 has been saved as specific paper information and paper type=plain paper, paper size=user-defined 209×1000 has been saved as paper information to the memory 252, the printer driver 304 will decide that the specific paper information and the paper information do not match (Step S204: No). If the printer driver 304 decides that the specific paper information and the paper information do not match, it will determine that the back end auto sheet feeder 104 is the paper feed port to be used (Step S208), and save this to the memory 252. In the event of a decision that specific paper information and the paper information match (Step S204: Yes), it will determine that the front end paper cassette 102 is the paper feed port to be used (Step S206).

As will be apparent from the description up to this point, when the user makes various print settings from the print settings window W1, the print settings of paper feed method=paper assignment-dependent and paper feed port=back end auto sheet feeder, as well as the paper information (paper type=plain paper, paper size=user-defined 209×1000) and the specific paper information (paper type=plain paper, paper size=user–defined 209×297) will be saved to the memory 252. Additionally, by way of user-defined paper information, user-defined paper information 1 (user-defined paper name=user-defined 209×297, user-defined paper width=209.0, user-defined paper length=297.0, paper size display flag=ON, specific paper display flag=ON, user-defined paper display flag=ON) and user-defined paper information 2 (user-defined paper name=user-defined 209×1000, user-defined paper width=209.0, user-defined paper length=1000.0, paper size display flag=ON, specific paper display flag=OFF, user-defined paper display flag=ON) will be saved to the memory 252. The user-defined paper display flag will be discussed later.

When the user selects the OK button B23 (FIG. 2) from the print settings window W1, the printer driver 304 will close the print settings window W1. When the user then selects the OK button (not shown) of the print window in the application 302 to instruct printing, the printer driver 304 will generate print data adapted to the printer 100 on the basis of the print conditions that have been set from the print settings window W1 and saved to the memory 252, and of text data that has been created by the application 302, and transfer this data to the printer 100. This print data includes an instruction to the effect to feed paper from the back end auto sheet feeder 104. The printer will then feed the paper from the back end auto sheet feeder 104, and print the document created by the application 302.

As discussed above, through the user-defined paper size window W3 the user is able to define and register a non-standard paper size. Here, when a user-defined paper name previously specified as a paper size from the paper assignment window W4 is entered in the user-defined paper name input field ic31 of the user-defined paper size window W3, and a size different from the registered user-defined paper size is entered in the user-defined paper width input field ic32, the user-defined paper size will be modified. For example, when "user-defined 209×297" has been entered as the paper size from the paper assignment window W4, if "User-defined 209×207" is input into the user-defined paper name input field ic31 of the user-defined paper size window W3, and a paper length that exceeds the length loadable in the front end paper cassette 102 is input and registered in the user-defined paper length input field ic33, a problem will result in that the size will be modified to one that cannot be made from the paper assignment window W4. The operation of the present embodiment for the purpose of preventing modification of user-defined paper size of a specified user-defined paper name when the user-defined paper name has been specified as the paper size through the paper assignment window W4 will be discussed below, with reference to FIGS. 8 through 11.

Figure 8:
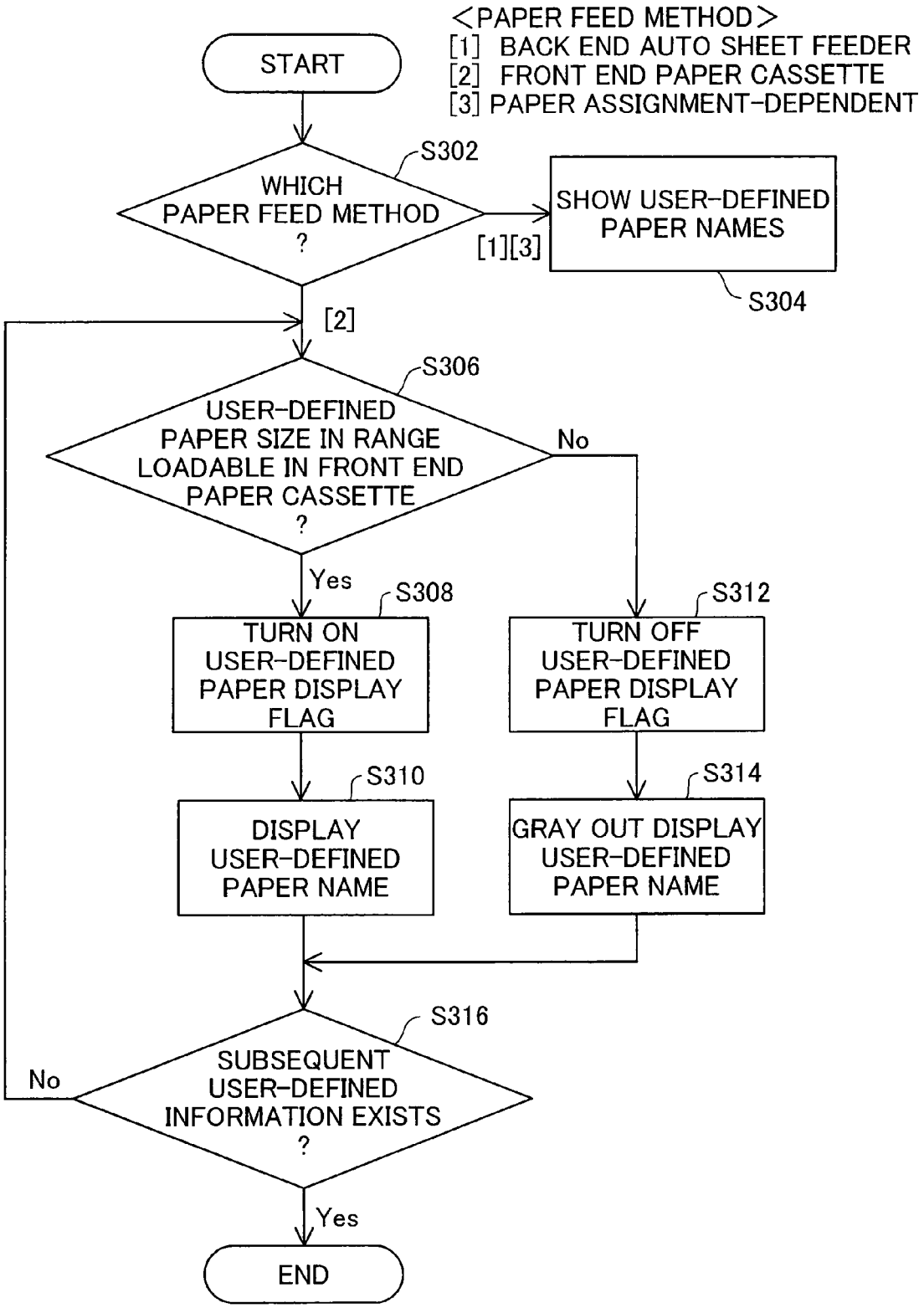
FIG. 8 is a flowchart showing a process for displaying a user-defined paper name on the user-defined paper name display portion dc31.
Figure 9:
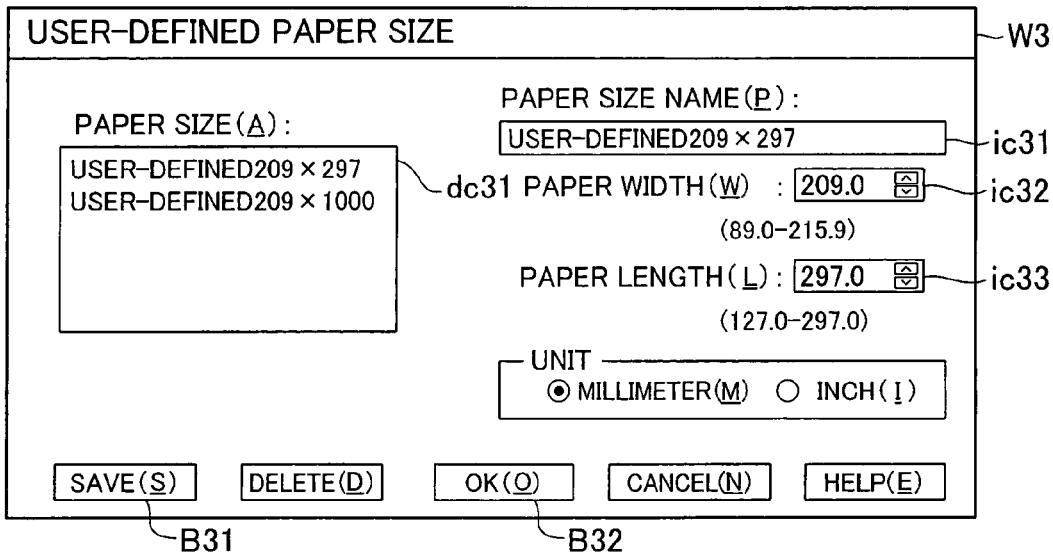
FIG. 9 is a diagram showing the user-defined paper size window W3.
Figure 10:
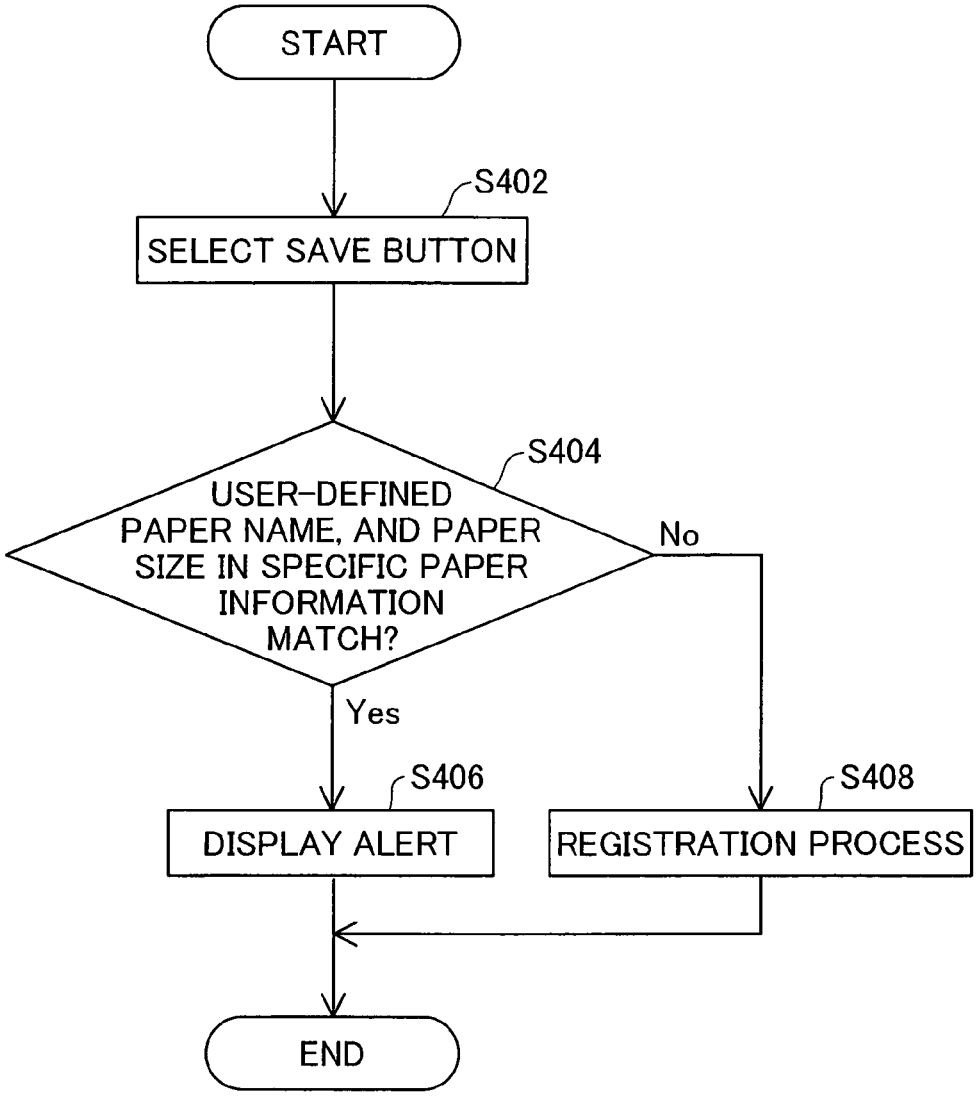
FIG. 10 is a flowchart showing a process for displaying an alert W5.
Figure 11:
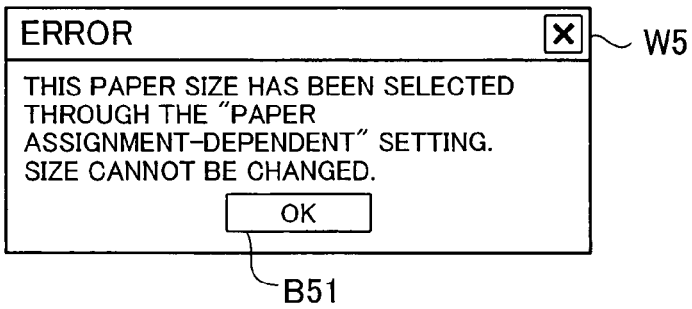
FIG. 11 is a diagram showing the alert W5.

FIG. 8 is a flowchart showing a process for displaying a user-defined paper name on the user-defined paper name display portion dc31 of the user-defined paper size window W3; FIG. 9 is a diagram showing the user-defined paper size window W3; FIG. 10 is a flowchart showing a process for displaying an alert W5; and FIG. 11 is a diagram showing the alert W5.

For example, let it be assumed that the print settings have been made as described above. Specifically, paper size=user-defined 209×297 has been saves as the specific paper information in the memory 252; and user-defined paper name=user-defined 209×297, user-defined paper width=209.0, and user-defined paper length=297.0 have been saved as user-defined paper information 1 in the memory 252. When, in the manner described earlier, the user brings up the print settings window W1 (FIG. 2), selects "Front end paper cassette" from the paper feed method pull down menu of the basic settings screen W2, and enters this setting in the paper feed method input field ic22, the printer driver 304 will acquire the input paper feed method and save it to the memory 252.

Then, when the user selects the Register user-defined paper size button B22, the printer driver 304 will display the user-defined paper size window W3 (FIG. 9), superimposed over the print settings window W1 on the display screen of the monitor 258. At this time, as shown in FIG. 8, the printer driver 304 will verify that the paper feed method saved in the memory 252 is "Front end paper cassette" (Step S302: [2]), and, proceeding in order from the user-defined paper information 1, will decide whether the user-defined paper width and user-defined paper length of the user-defined paper information saved to the memory 252 lie within the permissible front end paper width range (89.0-215.9 mm) and the permissible front end paper length range (127.0-297.0 mm) by respectively comparing them to the permissible front end paper width range and the permissible front end paper length range. First, the printer driver 304 will acquire and make a decision regarding the user-defined paper information 1 (Step S306); since as noted, in the user-defined paper information 1 the user-defined paper width is 209.0 and the user-defined paper length is 297.0, the printer driver 304 will decide that these lie within the paper size range loadable in the front end paper cassette 102 (Step S306: Yes), and will set to ON the corresponding user-defined paper display flag (Step S308), and display the corresponding "user-defined 209×297" on the user-defined paper name display portion dc31 (Step S310).

Next, the printer driver 304 will check the user-defined paper information 2 (Step S316: No) and make a similar decision (Step S308) with regard to this user-defined paper information 2 (user-defined paper name=user-defined paper 209×1000); since in the user-defined paper information 2 the user-defined paper width is 209.0 and the user-defined paper length is 1000.0, the printer driver 304 will decide that these values do not lie within the paper size range loadable in the front end paper cassette 102 (Step S306: No), and will set to OFF the corresponding user-defined paper display flag (Step S312), and display in non-selectable fashion and grayed-out the corresponding "user-defined 209×1000" on the user-defined paper name display portion dc31 (Step S314). In FIG. 9, "user-defined 209×1000" is shown in black in order for it to be displayed clearly. The printer driver 304 then verifies that no subsequent user-defined information has been saved to the memory 252 (Step S316: Yes), and terminates the process.

As shown in FIG. 9, when the user selects "user-defined 209×297" from the user-defined paper name display portion dc31, the printer driver 304 will acquire the selected user-defined paper name and display "user-defined 209×297" in the user-defined paper name input field ic31. Also, on the basis of the acquired "user-defined 209×297" the printer driver 304 will read the corresponding user-defined paper width and user-defined paper length from the memory 252, and display "209.0" in the user-defined paper width input field ic32 and "297.0" in the user-defined paper width input field ic33.

If the user then enters "208.0" into the user-defined paper width input field ic32 and selects the Save button B31 without first changing the entry in the user-defined paper name input field ic31, then as shown in FIG. 10 the printer driver 304 will verify that the Save button B31 has been selected (Step S402), look up the specific paper information saved in the memory 252, and determine whether the user-defined paper name entered in the user-defined paper name input field ic31 matches the paper size saved as specific paper information in the memory 252 (Step S404). As noted above, since paper size=user-defined 209×297 has been saved as the specific paper information in the memory 252, the printer driver 304 will decide that the user-defined paper name entered in the user-defined paper name input field ic31 and the paper size saved as the specific paper information in the memory 252 match (Step S404: Yes), and will display on the display screen of the monitor 258, shown superimposed over the print settings window W1, the alert W5 shown in FIG. 11, warning that, "This paper size has been selected through the "Paper assignment-dependent" setting. Size cannot be changed." (Step S406). When the user then selects the OK button B51 of the alert W5, the printer driver 304 will close the alert W5. At this time, the user-defined paper size window W3 will be displayed on the display screen of the monitor 258.

If the user then enters, for example, "User-defined 208×297" in the user-defined paper name input field ic31 and selects the Save button B31, as shown in FIG. 10, the printer driver 304 will verify that the Save button B31 has been selected (Step S402), and in the same manner as above will acquire the user-defined paper name and compare "User-defined 208×297" to the paper size stored as specific paper information in the memory 252 (Step S204). Since the paper size stored as specific paper information in the memory 252 is "user-defined 209×297," the printer driver 304 will decide that the user-defined paper name entered in the user-defined paper name input field ic31 and the paper size saved as the specific paper information do not match (Step S404: No). Specifically, the alert W5 will not be displayed.

Thereupon, the printer driver 304 will acquire the information that has been entered in the user-defined paper width input field ic32 and in the user-defined paper length input field ic33, and in the same manner as with registration of user-defined paper described above, will decide whether these lie respectively within the permissible front end paper width range (89.0-215.9 mm) and permissible front end paper length range (127.0-297.0 mm); and upon deciding that they are in-range, will save associated form user-defined paper name=user-defined 208×297, user-defined paper width=208.0, and user-defined paper length=297.0, as user-defined paper information 3 in the memory 252 (Step S408).

In this way, an alert will be displayed if it is attempted to modify paper size corresponding to a user-defined paper name that has been specified from the paper assignment window W4. Consequently, according to the printer driver program of the present embodiment, the user will be prevented from mistakenly modifying the paper size corresponding to the user-defined paper name.

As described above, according to the printer driver program of the present embodiment, the printer driver 304 will look up user-defined paper information saved in the memory 252, and display on a pull down menu or the like a user-defined paper name for a user-defined paper size loadable in the paper feed to be used. Where the user desires to specify a paper size for printing, the paper size name corresponding to the desired paper size can be selected from the pull down menu, and thus it will be possible to select paper of size appropriate for the paper feed port to be used for paper feed, even when a user-defined paper size has been selected.

While in the past, the front end paper cassette 102 could be loaded with only paper of standard size, according to the printer driver program of the present invention, a user-defined paper name can be displayed on the pull down menu even in instances where "Front end paper cassette" or "Paper assignment-dependent" has been selected as the paper feed method, and therefore the user will be able to specify a user-defined paper size as the paper for loading in the front end paper cassette 102.

B. Embodiment 2

The printer driver program pertaining to Embodiment 2 differs from the printer driver program pertaining to Embodiment 1 in terms of the process when registering a user-defined paper size and the process when displaying the paper size pull down menu pm23; however, other processes are similar to those of Embodiment 1 and will not be discussed in any detail.

Figure 12:
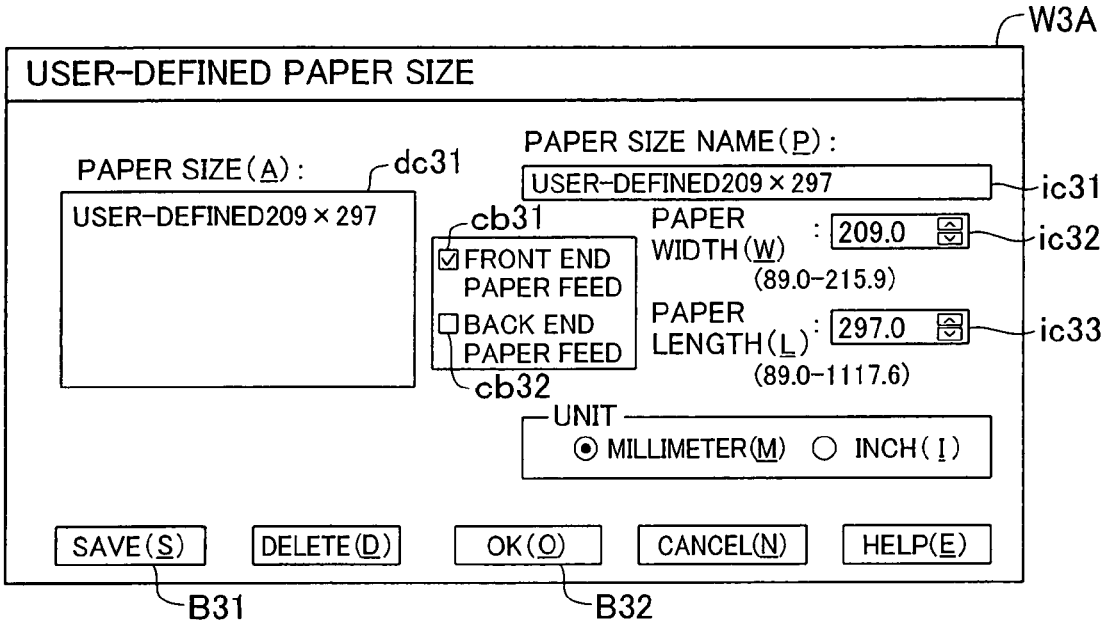
FIG. 12 is a diagram showing a user-defined paper size window W3A.

FIG. 12 is a diagram showing a user-defined paper size window W3A in the present embodiment. As shown, like the user-defined paper size window W3 in Embodiment 1, the user-defined paper size window W3A includes inter alia a user-defined paper name display portion dc31, a user-defined paper name input field ic31, a user-defined paper width input field ic32, a user-defined paper length input field ic33, a Save button B31, and an OK button B32 (identical elements are assigned identical symbols with Embodiment 1).

The user-defined paper size window W3A of the present embodiment further includes a front end paper feed checkbox cb31, and a back end paper feed checkbox cb32. The front end paper feed checkbox cb31 and the back end paper feed checkbox cb32 in the present embodiment correspond to the element of the feed port identifying portion recited in the claims.

These checkboxes cb31, cb32 are used for the user to register information relating to the paper feed port, when the user registers a user-defined paper size. For example, where the user intends to always use the printer 100 with paper of a given user-defined paper size loaded in the front end paper cassette 102 and never loaded in the back end auto sheet feeder 104, during registration of the user-defined paper size, a check may be placed in the front end paper feed checkbox cb31. By so doing, when back end paper feed is entered in the paper feed method input field ic22 in the print settings window W1, the paper name of that user-defined paper size will not be displayed on the paper size pull down menu p23.

Figure 13:
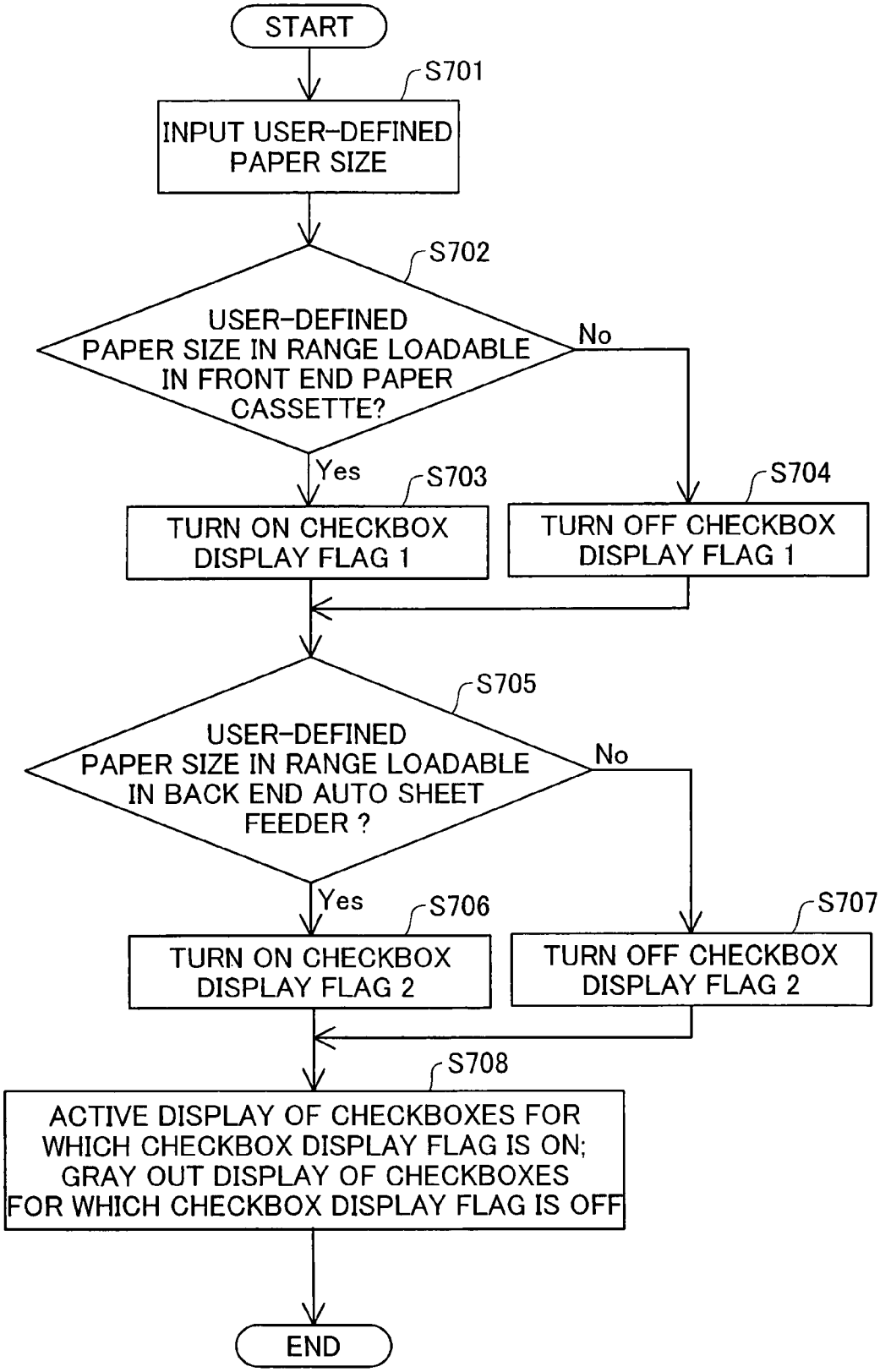
FIG. 13 is a flowchart showing a process of displaying checkboxes cb31, cb32.

FIG. 13 is a flowchart showing a process of displaying checkboxes cb31, cb32

The operation of the printer driver of the present embodiment will be described, taking the example of an instance where the user enters "Paper assignment-dependent" in the paper feed method input field ic22, and registers a user-defined paper size of 209 mm×297 mm. When as shown in FIG. 12, the user enters "User-defined 209 mm×297 mm" in the user-defined paper name input field ic32, enters "209.0" in the user-defined paper width input field ic32, and enters "297.0" in the user-defined paper length input field ic33 (FIG. 13: Step S701), the printer driver 304 will decide whether the user-defined paper size (width=209.0 mm, length=297.0 mm) lies within the paper size range (permissible front end paper width range, permissible back end paper width range) loadable in the front end paper cassette 102 (Step S702). In the present embodiment, since the user-defined paper width and the user-defined paper length are in-range, the printer driver 304 will set to ON the checkbox display flag 1 (Step S703). Next, the printer driver 304 will decide whether the user-defined paper size lies within the paper size range (permissible front end paper width range, permissible back end paper width range) loadable in the back end auto sheet feeder 104 (Step S705). In the present embodiment, since the user-defined paper width and the user-defined paper length are in-range, the printer driver 304 will set to ON the checkbox display flag 2 (Step S706). Since both of the checkbox flags 1, 2 are ON, the printer driver 304 will actively display both of the checkboxes cb31, cb32 (Step S708). Specifically, the checkboxes cb31, cb32 will be displayed selectably.

When the user now puts a check in the front end paper feed checkbox cb31 and selects the Save button B31, the printer driver 304 will acquire the values that were entered in the respective input fields. As described in Embodiment 1, when the printer driver 304 decides that the user-input values lie within the permissible back end paper width range (89.0-215.9 mm) and the permissible back end paper length range (89.0-1117.6 mm) constituting the definable paper size range, the parameters of user-defined paper name=user-defined 209×297, user-defined paper width=209.0, user-defined paper length=297.0, paper feed flag 1=ON, and paper feed flag 2=ON will be saved in associated form in the memory 252, and "User-defined 209×297" will be displayed in the user-defined paper name display portion dc31. The OK button B32 will then be displayed selectably in the user-defined paper size window W3A.

When the user then selects the OK button B32, the printer driver 304 will close the user-defined paper size window W3A. At this time, the print settings window W1 (FIG. 2) will be displayed on the display screen of the monitor 258.

By means of this procedure, during definition and registration of a nonstandard paper size by the user, the user can also register information regarding the paper feed port in which the paper will be loaded.

When the user-defined paper width and/or the user-defined paper length entered by the user is outside the range of paper size loadable in the front end paper cassette 102, the printer driver 304 will set the checkbox display flag 1 to OFF. In this case, the printer driver 304 will display the front end paper feed checkbox cb31 in grayed-out display (Step S708). Specifically, the front end paper feed checkbox cb31 will be displayed so that it cannot be selected. Similarly, when the user-defined paper width and/or the user-defined paper length entered by the user is outside the range of paper size loadable in the back end auto sheet feeder 104, the back end paper feed checkbox cb32 will be displayed in grayed-out display.

Figure 14:
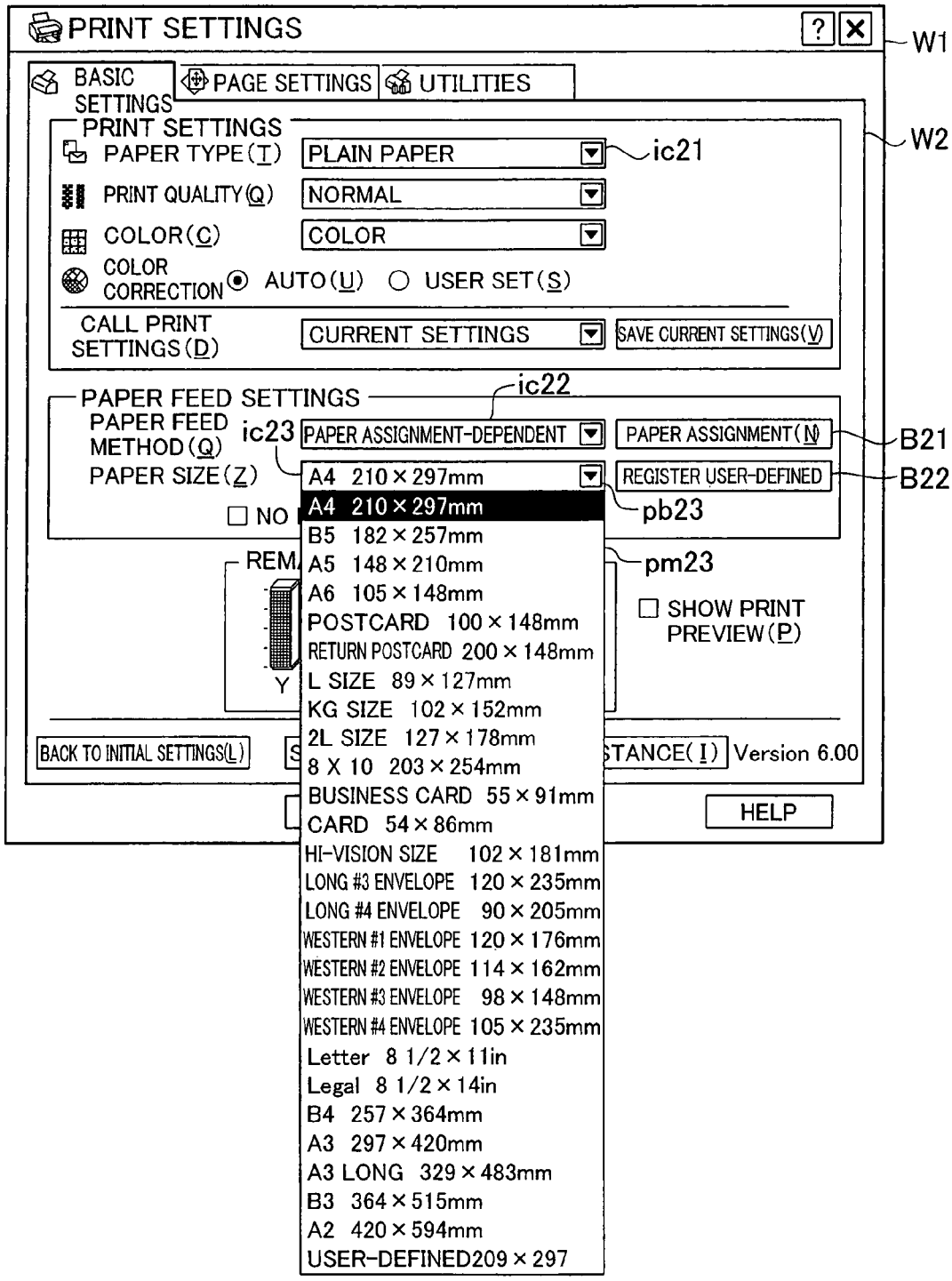
FIG. 14 is a diagram showing the paper size pull down menu pm23.

Next, when the user selects the pull down button pb23 of the paper size input field ic23 in the basic settings window W2 shown in FIG. 2, the printer driver 304 will display the paper size pull down menu pm23 as shown in FIG. 13. FIG. 14 is a diagram showing the paper size pull down menu pm23; and FIGS. 15 and 16 are flowcharts showing a process of displaying paper names on the paper size pull down menu pm23.

Figure 15:
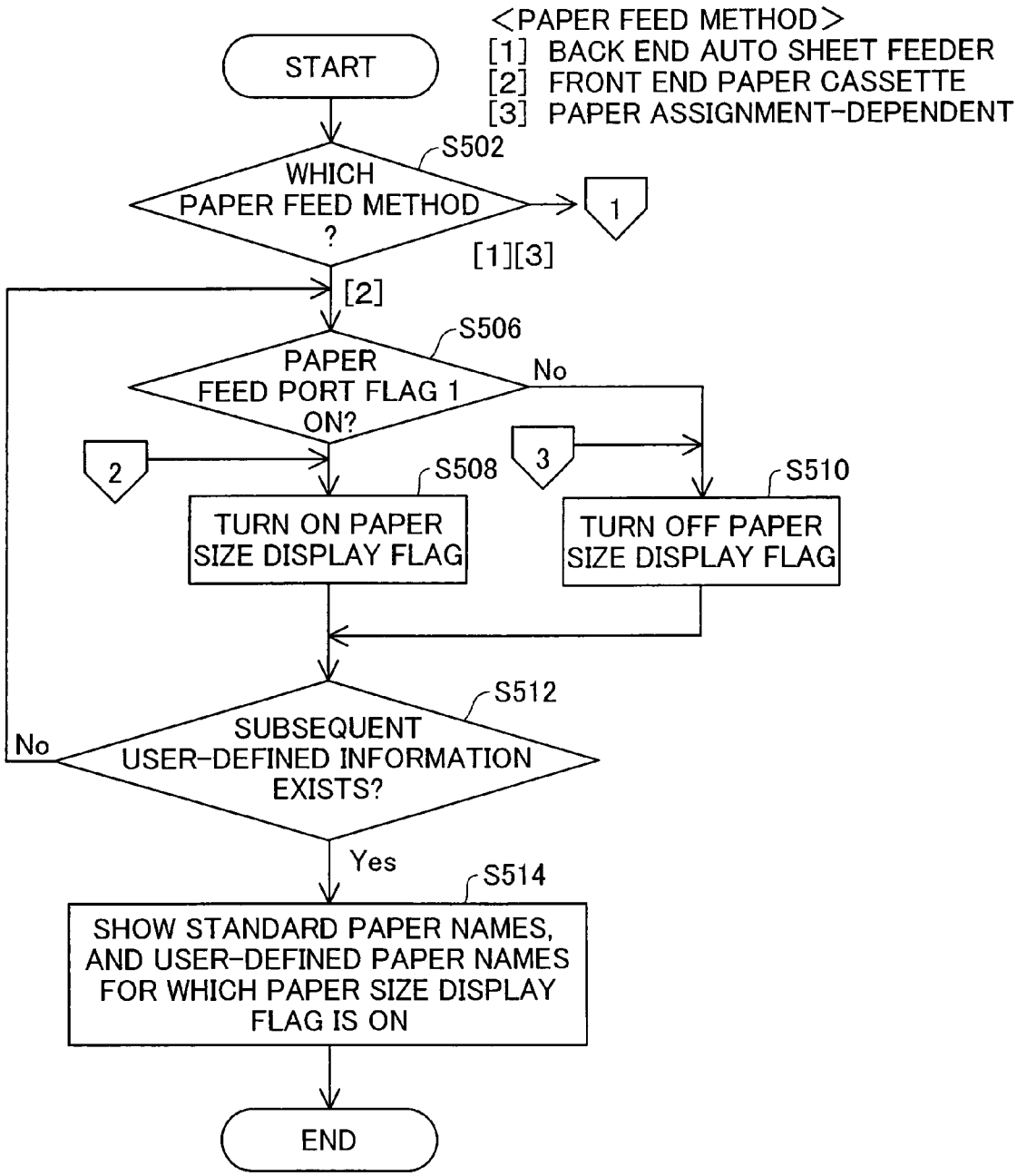
FIG. 15 is a flowchart showing a process of displaying paper names on the paper size pull down menu pm23.
Figure 16:
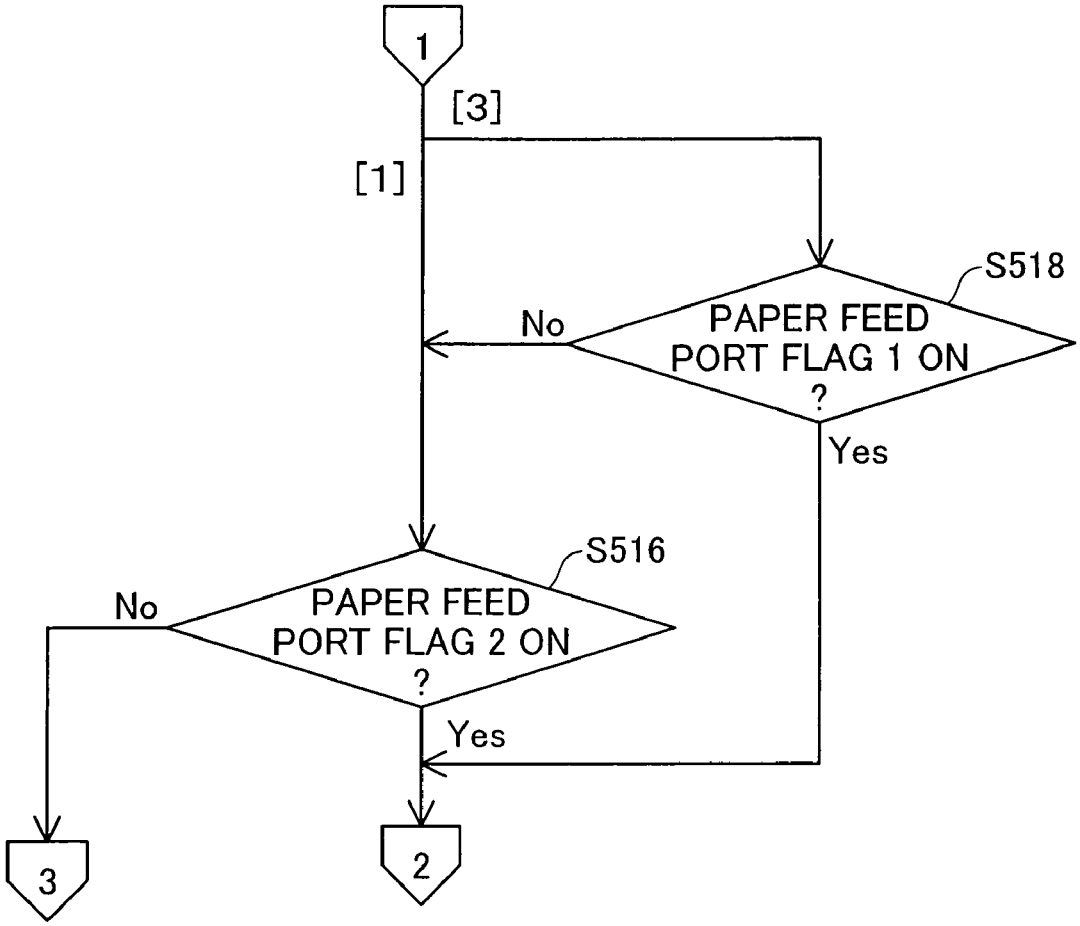
FIG. 16 is a flowchart showing a process of displaying paper names on the paper size pull down menu pm23.

As shown in FIG. 15, during display of the paper size pull down menu pm23, the printer driver 304 will determine the paper feed method that was entered in the paper feed method input field ic22 (Step S502); if it confirms that the setting is "Paper assignment-dependent" (Step S502: [3]), it will then acquire the paper feed port flag 1 of the user-defined paper information 1 saved in the memory 252, and determine whether the paper feed port flag 1 is ON, as shown in FIG. 16 (Step S518). As noted, since the paper feed port flag 1 is ON (Step S518: Yes), as shown in FIG. 15, the printer driver 304 will set to ON the paper size display flag of the user-defined paper information 1 saved in the memory 252 (Step S508). In the present embodiment, only one user-defined paper size is registered and there is no subsequent user-defined paper information (Step S512: Yes); therefore, the printer driver 304 will display the user-defined paper name of the user-defined paper information 1, namely, "user-defined 209×297," together with standard paper names loadable in the back end auto sheet feeder 104, on the paper size pull down menu pm23 (FIG. 14) (Step S514).

When, for example, the paper feed port flag 1 is OFF (FIG. 16: Step S518: No), the printer driver 304 will acquire the paper feed port flag 2 of the user-defined paper information 1 saved in the memory 252, and determine whether the paper feed port flag 2 is ON (Step S516); and when the paper feed port flag 2 is ON, will set to ON the paper size display flag of the user-defined paper information 1 saved in the memory 252 (Step S508). If on the other hand the paper feed port flag 2 is OFF (Step S516: No), it will set to OFF the paper size display flag of the user-defined paper information 1 saved in the memory 252 (FIG. 15: Step S510). Specifically, when the paper feed method is "Paper assignment-dependent," during registration of a user-defined paper size, if a check is placed in either the front end paper feed checkbox cb31 or the back end paper feed checkbox cb32, the user-defined paper name will be displayed on the paper size pull down menu pm23.

The description up to this point has taken the example of a case where the user has entered "Paper assignment-dependent" in the paper feed input field ic22; however, user-defined paper names for display on the paper size pull down menu pm23 will be determined (i.e. the paper size flags will be set to ON or OFF) on the basis of paper feed port information registered together with user-defined paper size in other instances as well.

For example, when "Back end auto sheet feeder" has been entered in the paper feed method input field ic22 (FIG. 15: Step S502: [1]), the paper feed port flag 2 of the user-defined paper information 1 saved in the memory 252 will be acquired and it will be determined whether the paper feed port flag 2 is ON (FIG. 16: Step S516), and if the paper feed port flag 2 is ON, the paper size display flag of user-defined paper information 1 saved in the memory 252 will be set to ON (FIG. 15: Step S508). If on the other hand, the paper feed port flag 2 is OFF, the paper size display flag of user-defined paper information 1 saved in the memory 252 will be set to OFF (Step S510).

When "Front end paper cassette" has been entered in the paper feed method input field ic22 (Step S502: [2]), the printer driver 304 will decide whether the paper feed port flag 1 is ON (Step S506), and if the paper feed port flag 1 is ON, will set to ON the paper size display flag of user-defined paper information 1 saved in the memory 252 (Step S508); if the feed port flag 1 is OFF, the paper size display flag will be set to OFF.

In this way, when the user selects a desired paper size from the paper size pull down menu pm23 and enters it in the paper size input field ic23, in relation to user-defined paper names, on the basis of the paper feed method entered in the paper feed method input field ic22, and the paper feed port information registered together with user-defined paper size (i.e. the paper feed port selected by the user during registration of user-defined paper size), there will be displayed in the paper size pull down menu pm23 user-defined paper names within the paper size range loadable in the paper feed port that will be used for paper feed. Accordingly, the user will be able to select a user-defined paper name of paper size appropriate for the paper feed port to be used for paper feed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer control method for controlling, by means of a computer equipped with a display screen, a printer having a plurality of feed ports for feeding a printing medium, the method comprising the steps of:

(a) displaying on the display screen:

a feed port specifying portion for a user to specify at least one of the feed ports from the plurality of feed ports;

a first size display portion for displaying a list of available printing medium sizes; and a first size specifying portion for the user to specify a printing medium size to be printed, on the basis of the list of available printing medium sizes displayed on the first size display portion;

(b) from pre-registered user-defined printing medium sizes which are non-standard paper sizes, identifying user-defined printing medium sizes included within a printing medium size permissible range dependent upon the feed port specified through the feed port specifying portion;

(c) controlling the printer so as to carry out printing of the printing medium size specified through the first size specifying portion;

(d) before performing step (c), displaying on the display screen:

a second size display portion for displaying a list of available printing medium sizes of a printing medium loadable in a particular feed port; and a second size specifying portion for the user to specify the printing medium size of a printing medium to be loaded in the particular feed port, on the basis of the list of available printing medium sizes displayed on the second size display portion;

(e) before performing step (c), from pre-registered user-defined printing medium sizes, identifying user-defined printing medium sizes that are included within a printing medium size permissible range dependent upon the particular feed port; and (f) when two or more of the feed ports including the particular feed port have been specified through the feed port specifying portion, determining whether the printing medium size specified through the second size specifying portion matches the printing medium size specified through the first size specifying portion; and if the printing medium size specified through the second size specifying portion matches the printing medium size specified through the first size specifying portion, controlling the printer so as to feed the printing medium from the particular feed port; wherein:

in step (d), the user-defined printing medium sizes identified in step (e) are displayed in the list of available printing medium sizes displayed on the second size display portion; and in step (a), user-defined printing medium sizes are only displayed on the first size display portion if identified in step (b).

2. The printer control method according to claim 1 further comprising the steps of:

(g) when the user registers a user-defined printing medium, displaying on the display screen:

a user-defined printing medium size input portion for inputting the user-defined printing medium size;

a registration specifying portion for the user to specify registration of the user-defined printing medium; and a third size display portion for displaying a list of user-defined printing medium sizes; and (h) when registration has been specified through the registration specifying portion, registering the user-defined printing medium size input through the user-defined printing medium size input portion;

wherein in step (g), the list of user-defined printing medium sizes identified in step (b) is displayed on the third size display portion.

3. The printer control method according to claim 1, wherein the printing medium size permissible range is defined by a lower limit value and an upper limit value for width of a printing medium loadable in the feed port, and a lower limit value and an upper limit value for length of a printing medium loadable in the feed port.

4. The printer control method according to claim 2 further comprising the step of:

(i) when a user-defined printing medium size is specified through the third size display portion, and the corresponding user-defined printing medium size is modified, determining whether the printing medium size specified through the second size specifying portion matches the currently specified user-defined printing medium size; and if the printing medium size specified through the second size specifying portion matches the currently specified user-defined printing medium size, alerting the user to the effect that the currently specified user-defined printing medium size cannot be modified.

5. A printer control method for controlling, by means of a computer equipped with a display screen, a printer having a plurality of feed ports for feeding a printing medium, the method comprising the steps of:

(a) displaying on the display screen:

a first size display portion for displaying information relating to printing medium sizes; and a first size specifying portion for the user to specify a printing medium size to be printed, on the basis of the information relating to printing medium sizes displayed on the first size display portion;

(b) when the user registers a user-defined printing medium, displaying on the display screen:

a user-defined printing medium size input portion for inputting the user-defined printing medium size;

a feed port identifying portion for identifying a feed port in which the printing medium of the user-defined printing medium size will be loaded; and a registration specifying portion for the user to specify registration of the user-defined printing medium;

(c) deciding whether the user-defined printing medium size input through the user-defined printing medium size input portion is included within printing medium size permissible ranges respectively dependent on the plurality of feed ports;

(d) when registration was specified through the registration specifying portion, registering the feed port identified through the feed port identifying portion, together with the user-defined printing medium size input through the user-defined printing medium size input portion; and (e) controlling the printer so as to carry out printing of the printing medium size specified through the first size specifying portion;

wherein in step (b), the feed port identifying portion is displayed in such a way as to permit identification of only the feed ports decided in step (c) to accommodate the user-defined printing medium size included within the printing medium size permissible range.

6. The printer control method according to claim 5 further comprising the step of:

(f) displaying on the display screen a feed port specifying portion for specifying at least one of the feed ports from the plurality of feed ports;

wherein in step (a), when the feed port registered together with the user-defined printing medium size in step (d) matches at least part of the feed port specified through the feed port specifying portion, displaying information relating to the user-defined printing medium size, on the first size display portion.

7. The printer control method according to claim 5 further comprising the steps of (g) displaying on the display screen:

a second size display portion for displaying information relating to printing medium sizes of a printing medium loadable in a specific feed port; and a second size specifying portion for the user to specify the printing medium size of a printing medium to be loaded in the selected feed port, on the basis of information relating to the printing medium sizes displayed on the second size display portion; and (h) when two or more of the feed ports including the specific feed port have been specified through the feed port specifying portion, determining whether the printing medium size specified through the second size specifying portion matches the printing medium size specified through the first size specifying portion; and if the printing medium size specified through the second size specifying portion matches the printing medium size specified through the first size specifying portion, controlling the printer so as to feed the printing medium from the specified feed port;

wherein in step (g), when the feed port registered together with the user-defined printing medium size in step (d) is the selected feed port, information relating to the user-defined printing medium size is displayed on the second size display portion.

8. A computer program product for controlling, by means of a computer equipped with a display screen, a printer having a plurality of feed ports for feeding a printing medium, the computer program product comprising:

a computer-readable medium; and a computer program stored on the computer readable medium, the computer program causing the computer to perform the steps of:

(a) displaying on the display screen:

a feed port specifying portion for specifying at least one of the feed ports from the plurality of feed ports;

a first size display portion for displaying information relating to printing medium sizes; and a first size specifying portion for the user to specify a printing medium size to be printed, on the basis of the information relating to printing medium sizes displayed on the first size display portion;

(b) from pre-registered user-defined printing medium sizes, identifying user-defined printing medium sizes included within a printing medium size permissible range dependent upon the feed port specified through the feed port specifying portion; and (c) controlling the printer so as to carry out printing of the printing medium size specified through the first size specifying portion;

(d) before performing step (c), displaying on the display screen:

a second size display portion for displaying a list of available printing medium sizes of a printing medium loadable in a particular feed port; and a second size specifying portion for the user to specify the printing medium size of a printing medium to be loaded in the particular feed port, on the basis of the list of available printing medium sizes displayed on the second size display portion;

(e) before performing step (c), from pre-registered user-defined printing medium sizes, identifying user-defined printing medium sizes that are included within a printing medium size permissible range dependent upon the particular feed port; and (f) when two or more of the feed ports including the particular feed port have been specified through the feed port specifying portion, determining whether the printing medium size specified through the second size specifying portion matches the printing medium size specified through the first size specifying portion; and if the printing medium size specified through the second size specifying portion matches the printing medium size specified through the first size specifying portion, controlling the printer so as to feed the printing medium from the particular feed port;

wherein in step (d), the user-defined printing medium sizes identified in step (e) are displayed in the list of available printing medium sizes displayed on the second size display portion; and wherein in step (a), information relating to a user-defined printing medium size is displayed on the first size display portion only if identified in step (b).

* * * * *